US006842689B2

(12) United States Patent
Andres et al.

(10) Patent No.: US 6,842,689 B2
(45) Date of Patent: Jan. 11, 2005

(54) SYSTEM FOR DYNAMICALLY CONTROLLING POWER PROVIDED BY AN ENGINE

(75) Inventors: David J. Andres, Washington, IL (US); Craig W. Riediger, Cologny (CH); Donald E. Wilson, Bad Abbach (DE); John P. Timmons, Chillicothe, IL (US); Timothy A. Lorentz, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/424,846

(22) Filed: Apr. 29, 2003

(65) Prior Publication Data

US 2003/0216219 A1 Nov. 20, 2003

Related U.S. Application Data

(60) Provisional application No. 60/380,272, filed on May 15, 2002.

(51) Int. Cl.[7] ..... G06G 7/70

(52) U.S. Cl. ..... 701/110; 123/350; 73/117.3; 73/116; 340/439; 701/102; 701/104; 701/114; 701/115

(58) Field of Search ..... 701/110, 114, 701/102, 104, 115; 73/112, 116, 117.3; 123/350; 340/439

(56) References Cited

U.S. PATENT DOCUMENTS

| | | | | |
|---|---|---|---|---|
| 4,319,327 | A | 3/1982 | Higashiyama et al. | 364/431.05 |
| 4,368,705 | A | 1/1983 | Stevenson et al. | 123/415 |
| 4,658,943 | A | 4/1987 | Nishikawa et al. | 364/424 |
| 4,823,555 | A | 4/1989 | Ohkumo | 62/133 |
| 4,829,440 | A | 5/1989 | Abe | 364/431.06 |
| 5,019,986 | A | 5/1991 | Londt et al. | 364/426.04 |
| 5,091,858 | A | 2/1992 | Paielli | 364/431.12 |
| 5,123,239 | A | 6/1992 | Rodgers | 60/39.02 |
| 5,126,943 | A | 6/1992 | Nakaniwa | 364/431.05 |
| 5,189,621 | A | 2/1993 | Onari et al. | 364/431.04 |
| 5,233,889 | A | 8/1993 | Iizuka | 74/866 |
| 5,257,193 | A | 10/1993 | Kusaka et al. | 364/431.07 |
| 5,323,318 | A | 6/1994 | Hasegawa et al. | 364/424.01 |
| 5,343,780 | A | 9/1994 | McDaniel et al. | 477/108 |
| 5,394,327 | A | 2/1995 | Simon, Jr. et al. | 364/424.01 |
| 5,445,906 | A | 8/1995 | Hobson et al. | 29/623.3 |
| 5,455,767 | A | 10/1995 | Staerker | 364/424.01 |
| 5,457,633 | A | 10/1995 | Palmer et al. | 364/431.09 |
| 5,484,351 | A | 1/1996 | Streib et al. | |
| 5,508,923 | A | 4/1996 | Ibamoto et al. | 364/426.01 |
| 5,508,943 | A | 4/1996 | Batson et al. | 364/551.01 |
| 5,586,538 | A | 12/1996 | Barnes | 123/440 |
| 5,612,873 | A | 3/1997 | Ogawa | 364/424 |

(List continued on next page.)

FOREIGN PATENT DOCUMENTS

| | | |
|---|---|---|
| DE | 10059563 | 3/2002 |

*Primary Examiner*—Willis R. Wolfe
*Assistant Examiner*—Johnny H. Hoang
(74) *Attorney, Agent, or Firm*—Finnegan, Henderson, Farabow, Garrett & Dunner

(57) ABSTRACT

A method and system may be provided to perform a process for controlling power provided by an engine in a machine. In an embodiment of the present invention, a process for controlling power provided by an engine operating in a machine is provided. The process may include determining a first power value reflecting a predetermined first power to be provided by the engine to a component operating in the machine and determining, during machine operations, at least one of a parasitic load power value and an intermittent power load value. A second power value may then be determined that reflects a second power provided by the engine based on the parasitic power value, the intermittent power value, and the net power value. The second power value is adjusted such that the engine substantially provides the predetermined net power to the component.

22 Claims, 7 Drawing Sheets

U.S. PATENT DOCUMENTS 5,623,906 A 4/1997 Storhok
5,797,110 A 8/1998 Braun et al. ..... 701/84
5,884,210 A 3/1999 Rettig et al. ..... 701/115
5,938,716 A 8/1999 Shutty et al. ..... 701/115
5,979,402 A 11/1999 Melbourne ..... 123/339.16
6,016,459 A 1/2000 Isaac et al. ..... 701/102
6,065,446 A 5/2000 Schuerz et al.
6,076,036 A 6/2000 Price et al. ..... 701/93
6,094,617 A * 7/2000 Lapke ..... 701/104
6,135,918 A 10/2000 Bellinger et al. ..... 477/111
6,173,227 B1 1/2001 Speicher et al. ..... 701/51
6,173,696 B1 1/2001 Ellies et al.
6,199,006 B1 3/2001 Weiss et al. ..... 701/102
6,208,925 B1 3/2001 Creger et al. ..... 701/51
6,226,585 B1 5/2001 Cullen ..... 701/54
6,328,014 B1 12/2001 Bradshaw ..... 123/300
6,580,977 B2 * 6/2003 Ding et al. ..... 701/22
2002/0010534 A1 1/2002 Goodnight et al. ..... 701/54
2003/0079720 A1 5/2003 McCauley et al.
2003/0109977 A1 * 6/2003 Landes et al. ..... 701/54

* cited by examiner

SYSTEM FOR DYNAMICALLY CONTROLLING POWER PROVIDED BY AN ENGINE

CROSS REFERENCE TO RELATED APPLICATIONS

This application claims the benefit of U.S. Provisional Application Ser. No. 60/380,272 entitled, System for Dynamically Controlling Power Provided by an Engine, filed May 15, 2002, owned by the assignee of this application and expressly incorporated herein by reference in its entirety.

TECHNICAL FIELD

This invention relates generally to engine control systems, and more particularly to methods and systems for dynamically controlling engine power based on parasitic and/or intermittent loads.

BACKGROUND

Engines are typically designed according to operating limits associated with certain component attributes. For example, certain engine specifications, such as fuel injection timing, fluid pump design, cooling system capabilities, etc., of an engine may be designed with operating limits corresponding to various parameters, such as engine speed and torque. The relationship between an engine's operating limits and selected operating parameters are sometimes represented as software-based performance maps that an engine controller may access to provide control signals to an engine to ensure the engine operates within the boundaries reflected by the operating limits.

A performance map for a particular engine may include several different performance curves based on varying load conditions. For example, a engine may be designed to follow a first engine calibration performance curve when a transmission is operating in a first set of selected gears and follow a second engine calibration performance curve when the transmission is operating in a second set of gears. Thus, when a vehicle experiences different loads, the controller may provide appropriate control signals to adjust power to the engine. Although such electronic engine control systems allow power to an engine to be adjusted based on varying load conditions, the control is limited to predetermined performance curves and predetermined performance limits. For example, an engine that is associated with a plurality of engine calibration performance curves can only be controlled to "jump" from one curve to another when experiencing a change in load conditions.

One conventional vehicle control system that diverges from the restrictions of known performance curve "jumping" is U.S. Pat. No. 6,173,227 issued to Speicher et al. This patent describes a process for dynamically controlling transmission ratios in a continuously variable gear system. The process determines an upper and lower driving range bounded by, for example, upper and lower transmission gear ratios designed for an engine. Based on conditions exposed, the process allows a host transmission system to be dynamically controlled within a variable range within the upper and lower ratio boundaries. The range may be adjusted by, for example, lowering the upper boundary and/or raising the lower boundary. Although the dynamic control process taught by Speicher et al. allows a system to operate within a variable range, the process is limited to transmission gear ratio applications. Further, Speicher et al. does not allow the upper and/or lower limits to be adjusted beyond their designed limits, thus limiting driving modes to performance ranges that are narrowly defined within these limits.

Additionally, during operations, engines may experience a momentary exposure to a loading condition that may warrant operations that may exceed maximum performance operating limits. One conventional engine control system that attempts to address momentary power demands is described in U.S. Pat. No. 5,123,239 issued to Rodgers. Although the engine control system described by Rodgers enables an engine to receive a momentary "torque burst," the excess torque provided by the system is limited to starter systems and operations.

SUMMARY OF THE INVENTION

In an embodiment of the present invention, a process for controlling power provided by an engine operating in a machine is provided. The process may include determining a first power value reflecting a predetermined first power to be provided by the engine to a component operating in the machine. Further, the process may include determining, during machine operations, at least one of a parasitic power value reflecting power received by a parasitic load module from the engine and an intermittent power value reflecting power received by an intermittent load module from the engine. A second power value may then be determined that reflects a second power provided by the engine based on the parasitic power value, the intermittent power value, and the net power value. Based on changes in at least one of the parasitic power value and the intermittent power value, the process may adjust the second power value such that the engine consistently provides the predetermined net power to the component.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to the exemplary embodiments of the invention, examples of which are illustrated in the accompanying drawings. Wherever possible, the same reference numbers will be used throughout the drawings to refer to the same or like parts.

Figure 1:
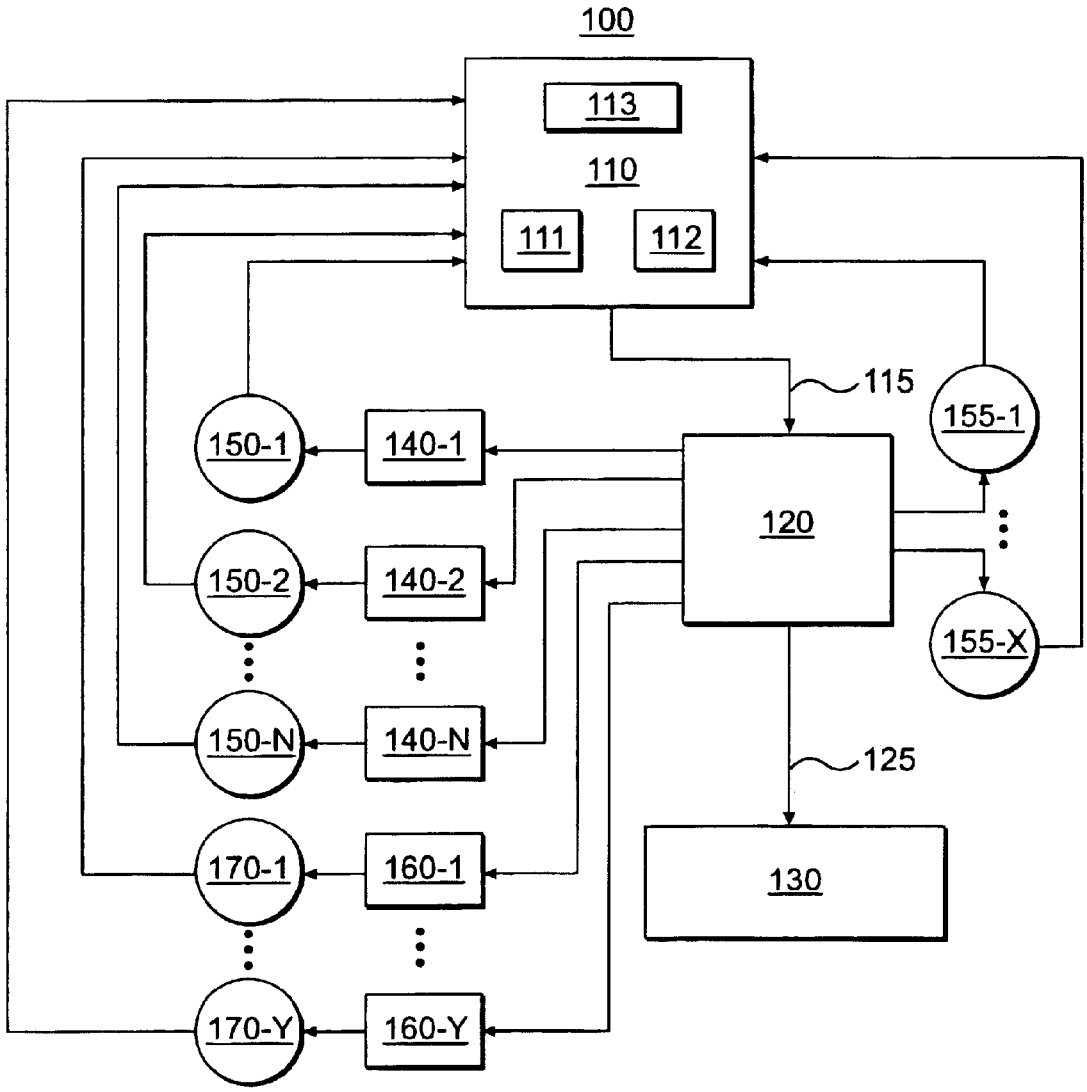
FIG. 1 illustrates an exemplary engine control system consistent with certain principles related to embodiments of the present invention.

FIG. 1 illustrates an exemplary system 100 in which features and principles consistent with embodiments of the present invention may be implemented. In one embodiment of the invention, system 100 may be associated with any type of machine, such as a machine that includes a combustion type engine. For example, system 100 may affiliated with a marine vehicle, land vehicle, and/or an aircraft. Further, the vehicle may be exposed to particular work applications, such as a tractor with hydraulically controlled accessory components (e.g., front end loader). Alternatively, system 100 may be associated with non-vehicle machines, such as a machine that includes an engine that drives manufacturing equipment in a manufacturing plant. Accordingly, system 100 may be associated with any type of machine that includes various types of engines that may operate in different environments.

In one embodiment of the invention, system 100 may include a controller 110, engine 120, Main Power Recipient (MPR) 130, parasitic load modules 140-1 to 140-N, parasitic sensors 150-1 to 150-N, engine sensors 155-1 to 155-X, intermittent load modules 160-1 to 160-Y, and intermittent sensors 170-1 to 170-Y. Controller 110 may be a hardware and/or software based processing module that is configured to perform one or more control processes based on data received from sensors 150-1 to 150-N, 155-1 to 155-X, 170-1 to 170-Y, and/or any other sensors that may operate in system 100. The processes performed by controller 110 may provide one or more control signals 115 that are directed to engine 120 for controlling the operations of engine 120 and/or system 100. Further, controller 110 may provide control signals to other components (not shown) included within system 100. Controller 110 may include one or more processor modules, memory devices, interface modules, and any other software and/or hardware-based components that collectively perform various types of engine/system control functions. For example, as shown in FIG. 1, controller 110 includes a processor 111, memory device 112, and interface device 113.

Processor 111 may be a processing device, such as a microprocessor or microcontroller, that may execute and/or exchange information with memory 112 and interface 113 to perform certain processes consistent with features related to the present invention. Although a single processor 111 is shown in FIG. 1, one skilled in the art would recognize that controller 110 may include a plurality of processors that operate collectively to perform functions consistent with certain embodiments of the present invention.

Memory 112 may be any type of storage device that is configured to store information used by processor 111. For example, memory 112 may include one or more magnetic, semiconductor, tape, and/or optical type storage devices that may be volatile or non-volatile in nature. Moreover, memory 112 may include one or more storage devices configured in various architectures, such as redundant configurations for fault tolerant operations. The type, configuration, and architecture of memory 112 may vary without departing from the spirit and scope of the present invention. In one embodiment of the invention, memory 112 may store engine performance maps that reflect performance curves associated with various specifications associated with engine 120. The performance maps may be provided to memory 112 during the development of system 100. Alternatively, the maps may be provided to memory 112 after system 100 has been developed and commissioned to work operations.

Interface 113 may be an input/output interface device that receives data from processor 111 and from entities external to controller 110, such as sensors 150-1 to 150-N, 170-1 to 170-Y, and/or sensors 155-1 to 155-X. Further, interface 113 may also provide data to processor 111 and other components external to controller 110 (not shown). Interface 113 may be a module that is based on hardware, software, or a combination thereof. Further, the configuration of interface 113 may vary without departing from the scope of the present invention. For example, interface 113 may include separate communication ports dedicated for receiving and sending data, respectively.

Engine 120 may be any type of combustion engine known in the art, such as a diesel engine that provides power for a machine (e.g., system 100). Engine 120 may include components that collectively determine the amount of power (e.g., horsepower) that may be provided to MPR 130 through, for example a flywheel 125. For example, engine 120 may include fuel injection components that provide certain amounts of fuel at dynamically controlled intervals of time. The types of components included in engine 120 may vary based on the type of engine 120.

MPR 130 may be any type of module, system, component, etc. that may receive power provided by engine 120 through an output component, such as flywheel 125. For example, MPR 130 may be a transmission system that transfers power received from flywheel 125 to other components of system 100, such as a wheel axle. Alternatively, MPR 130 may represent a drive train associated with a transmission system operating in system 100. Accordingly, MPR 130 may reflect a system, or component thereof, that may be designed to receive a portion of the power provided by engine 120 e.g., a hydraulic pump. In one embodiment, the MPR 130 may be configured to receive a predetermined net power that may be a substantial amount, or a majority of the power provided by engine 120, although in other embodiments it need not be. The predetermined net power may be a single predetermined value that is based on performance and design limits associated with MPR 130. Alternatively, the predetermined net power may be power that may dynamically change during engine operations as a function of external components. For example, the predetermined net power received by MPR 130 from engine 120 may dynamically change based on sensory and/or operator controlled input signals.

Parasitic load modules 140-1 to 140-N, where N may be any positive whole number greater than 1, each may be any type of component operating within system 100 that draws parasitic power from engine 120. Parasitic power may be power that is taken from the gross power provided by engine 120. In one embodiment of the invention, the gross engine power may be associated with the total of the power provided to MPR 130 and the power provided to any parasitic load modules operating within system 100. Parasitic load modules 140-1 to 140-N may be associated with components included in system 100 that operate without operator (e.g., manual) intervention. For example, parasitic load modules 140-1 to 140-N may be associated with an electrical-based system (e.g., alternator), a cooling system (e.g., cooling fans), a power take-off system (e.g., accessory drive shafts), and any other type of accessory component that may automatically draw parasitic power from engine 120 during operations of system 100. Although system 100 is shown to include a plurality of parasitic load modules 140-1 to 140-N, system 100 may be configured with a single module 140.

Sensors 150-1 to 150-N may be physical sensors that collect values associated with various operating parameters associated with parasitic load modules 140-1 to 140-N. In one embodiment of the invention, sensors 150-1 to 150-N may provide signals indicating which parasitic load modules are "on" or "off" during runtime operations of system 100. Further, the signals may include information reflecting how much engine power is being used by each operating parasitic load module 140-1 to 140-N. Although system 100 is shown to include corresponding sensors for each parasitic load module, various combinations of sensors 150-1 to 150-N may be implemented, such as a single sensor that collects data from a plurality of parasitic load modules.

Sensors 155-1 to 155-X, where X may be any positive whole number greater than 1, may be physical sensors that collect values associated with various operating parameters corresponding to engine 120. For example, sensors 155-1 to 155-X may collect data associated with engine speed, temperatures, pressures, injection characteristics, and any other type of parameter that may be associated with the operations of engine 120. Further, system 100 may be configured to include one or more separate sensors (not shown) that monitor operations directly from MPR 130 and provide data to controller 110 based on the monitored operations.

Intermittent load modules 160-1 to 160-Y, where Y may be any positive whole number greater than 1, may be any type of component that draws additional parasitic power from the gross power produced by engine 120. Intermittent load modules 160-1 to 160-Y may be components included in system 100 that operate based on human intervention. For example, a hydraulic-based system that controls a shovel/blade may be an intermittent load module that may be selectively switched "on" or "off" by an operator of a tractor. Accordingly, an intermittent load module 160-1 to 160-Y (e.g., hydraulic-based system) may be switched "on" or "off" by an operator associated with system 100 during system operations. Although system 100 is shown to include a plurality of intermittent load modules 160-1 to 160-Y, system 100 may be configured with a single module 160.

Sensors 170-1 to 170-Y may be physical sensors that collect values associated with various operating parameters associated with intermittent load modules 160-1 to 160-Y. In one embodiment of the invention, sensors 170-1 to 170-Y may provide signals indicating which intermittent load modules are "on" or "off" during runtime operations of system 100. Further, the signals may include information reflecting how much engine power is being used by each operating intermittent load module 160-1 to 160-Y. Although system 100 is shown to include corresponding sensors for each intermittent load module, various combinations of sensors 170-1 to 170-Y may be implemented, such as a single sensor that collects data from a plurality of intermittent load modules.

In one embodiment of the invention, a development system may perform a process that creates performance maps associated with particular types of engines. The development system may be associated with an entity that designs, develops, and/or manufactures system 100. Alternatively, the development system may be associated with an entity that adjusts software stored within memory 112 based on the specifications of engine 120 after development.

Figure 2:
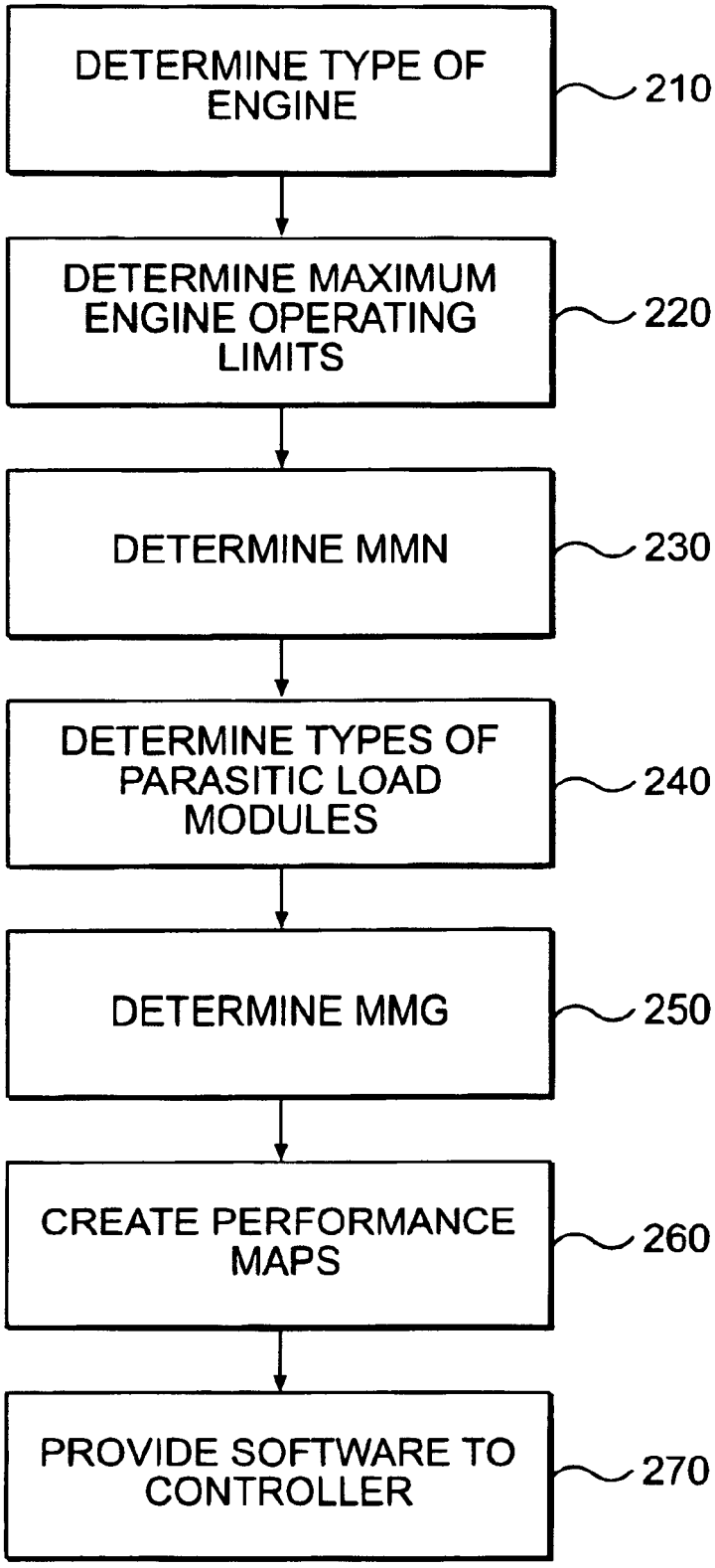
FIG. 2 illustrates a flowchart of an exemplary development process consistent with certain principles related to embodiments of the present invention.

FIG. 2 shows a flowchart of a development process that may be performed by the development system. As shown, the development system may first determine a type of engine 120 that is included in system 100 (Step 210). The type of engine 120 may be associated with the performance iron corresponding to the design specification of engine 120. The performance iron of an engine may be an engine characteristic that describes the design traits of a particular engine. In one embodiment the characteristics that define an engine's performance iron may be associated with the components that are included with, or support, the engine. For example, the performance iron of engine 120 may define characteristics associated with the physical and functional specifications of fuel injectors, turbocharger components, mechanical unit injectors, pumps, and any other engine component that may be included with engine 120. In general, the performance iron of engine 120 is associated with any components that determine how much power may be produced by engine 120. Based on the type of engine 120, the development system may determine (e.g., calculate or receive) a maximum machine power limit that may be produced by engine 120 (Step 220).

Additionally, the development system may determine a Maximum Machine Net (MMN) power that is associated with engine 120 and/or MPR 130 (Step 230). For example, depending on the type of system MPR represents, the development system may determine at various engine speeds (e.g., Revolutions Per Minute (RPMs)), the maximum amount of power that the MPR 130 can handle without experiencing a failure. Therefore, if MPR 130 is a transmission system, the development system may determine that at 2100 RPMs, the transmission would not be able to handle power over 100 HP received from flywheel 125 before one or more components fail. In one embodiment of the invention, the MMN is determined to be at or below the maximum machine power limit associated with engine 120.

Further, the development system may determine the types of selected parasitic load modules 140-1 to 140-N included in system 100 (Step 240). Based on the determined types, the development system may determine, for each selected module 140-1 to 140-N, the amount of power that may be drawn from engine 120 at particular engine speeds (e.g., RPMs) and operating conditions. For example, a cooling system may draw 6 HP from engine 120 at 2100 RPMs, while an alternator device may draw 2 HP at the same speed. The power drain information for each module 140-1 to 140-N may be obtained from specifications previously determined by manufacturers of each module, or may be determined by testing the modules 140-1 to 140-N, e.g., during test operations of system 100 in a testing environment. The manner from which the development system determines the type and power drain of each module 140-1 to 140-N may vary without departing from the scope of the invention. For example, the development system may be configured to assign a fixed power draw (e.g., maximum power draw) for one or more selected modules 140-1 to 140-N, that ignores engine speed.

In addition to the parasitic load modules, the development system may determine the types of intermittent load modules 160-1 to 160-Y that are included in system 100. The determined type information may include potential power requirements for each module 160-1 to 160-Y. The power drain information for each module 160-1 to 160-Y may be obtained from specifications previously determined by manufacturers of each module, or may be determined by testing the modules 160-1 to 160-Y, e.g., during test operations of system 100 in a testing environment. The manner from which the development system determines the type and power drain of each module 160-1 to 160-Y may vary without departing from the scope of the invention. For example, the development system may be configured to assign a fixed power draw (e.g., maximum power draw) for one or more selected modules 160-1 to 160-Y, that ignores engine speed.

Based on the determined MMN and parasitic load power drain information, the development system may determine a Machine Maximum Gross (MMG) power that engine 120 is to provide at various speeds (Step 250). In one embodiment of the invention, the MMG power may be determined as the sum of the power associated with the determined MMN power and the appropriate parasitic power required by the selected parasitic load modules 140-1 to 140-N. As an exemplary equation, the MMG power may be reflected as:

$$MMG=MMN+Pt,$$

where Pt is the total power reflecting a sum of all the power that may be required by parasitic load modules 140-1 to 140-N (e.g., P(140-1)+P(140-2)+ . . . +P(140-N)).

Figure 3:
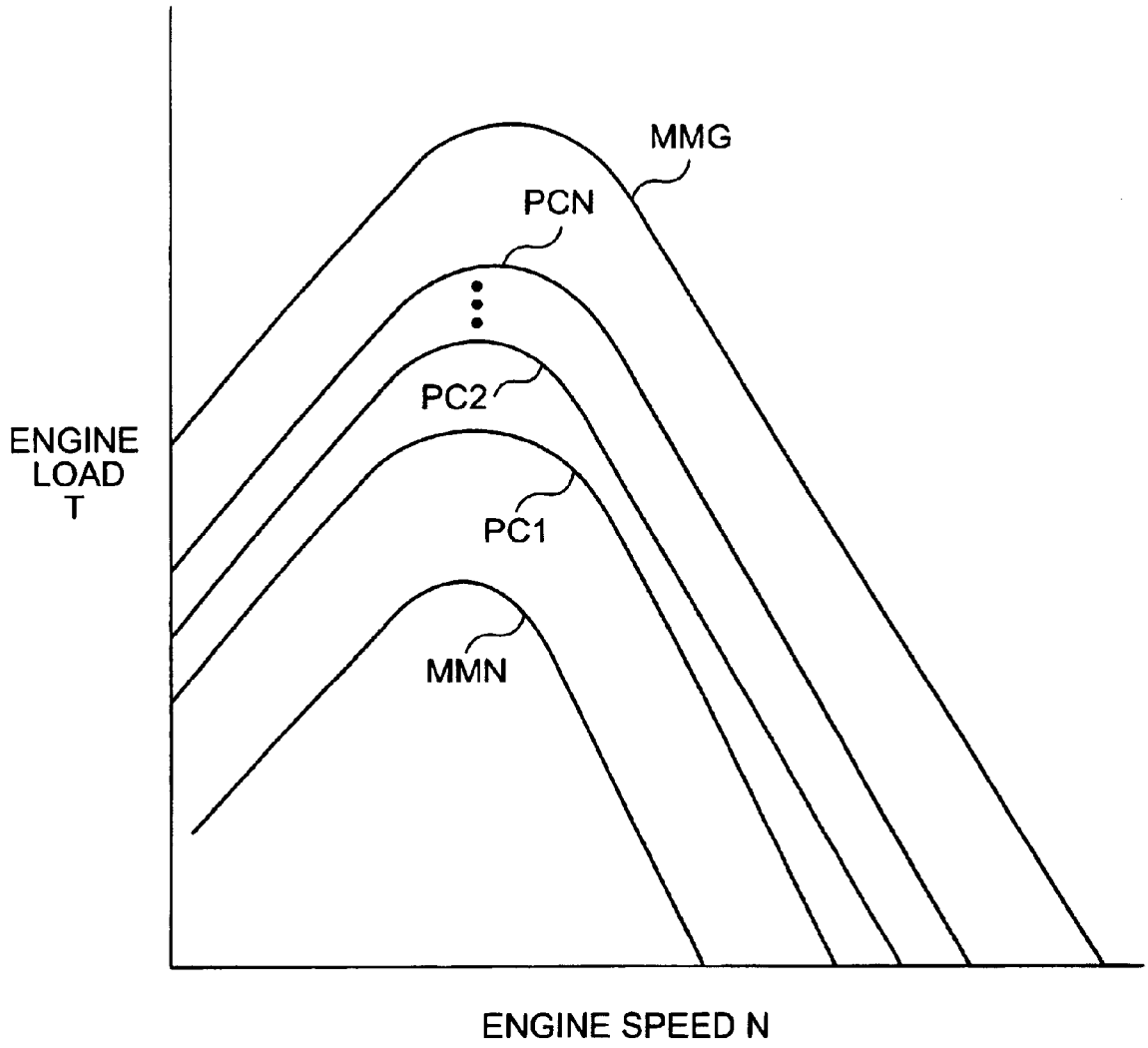
FIG. 3 illustrates an exemplary performance graph that may be stored as a performance map within a controller consistent with certain principles related to embodiments of the present invention.

For example, FIG. 3 shows a performance graph that includes various performance curves that engine 120 may be designed to follow. Each performance curve may reflect a relationship between engine load (T) and engine speed (N) based on various loads that engine 120 may experience. For example, the performance curve MMN reflects the performance curve engine 120 may follow when only providing the maximum net power to MPR 130. Performance curve MMG, on the other hand, may reflect the performance curve engine 120 may follow when providing net power (e.g., MMN) to MPR 130 and power (e.g., full power) to every parasitic load module 140-1 to 140-N. Between the MMN and MMG curves, the development system may determine a plurality of performance curves associated with various combinations of parasitic loads that may be experienced by engine 120. For example, curve PC1 may reflect a performance curve that engine 120 may be designed to follow when engine 120 is providing maximum net power to MPR 130 (MMN) and power to one type of parasitic load module 140-1 to 140-N, such as an cooling system. Curve PC2, on the other hand, may be associated with a performance curve that engine 120 may follow when providing power to MPR 130 and two predetermined types of parasitic load modules, e.g., the cooling system, and an alternator system. Accordingly, the development system may determine any combination of performance curves PC1-PCN based on the number of selected parasitic load modules 140-1 to 140-N determined in Step 240.

The development system may create hardware, firmware, or software that reflects performance maps that show the relationships included in the one or more performance graphs (Step 260). The software, firmware, etc., may then be stored in memory 112 within controller 110 (Step 270). Controller 110 may use the performance maps during runtime operations to adjust the power produced by engine 120 based on detected parasitic loads, as will be described below. Additionally, the development system may provide software-based, firmware-based, etc. processes in memory 112 that may be executed by controller 110 to perform various functions, such as dynamically determining gross engine power based on detected parasitic and intermittent loads to maintain a constant net power delivered to MPR 130. In one embodiment of the invention, constant net power may be associated with net power that is the same or substantially the same level of power. For example, a net power may be considered constant if the net power fluctuates between a predetermined range of acceptable power values, such as plus or minus 0.25 HP. Thus, if a net power level is determined by embodiments of the present invention to be 100 HP, an acceptable variance of 0.10 HP may be defined. Therefore, when engine 120 produces 99.95 HP to MPR 130, controller 110 may determine that this is within the acceptable 0.10 variance value and thus make no changes to adjust the net power.

In one embodiment of the invention, the performance curves and various power limit values stored in memory 112 may be based on the parasitic load modules 140-1 to 140-N. The reason behind this concept is based on the net power limit associated with MPR 130. Because the MMG power associated with engine 120 is a function of MMN and the parasitic power requirements, the MMG may not account for the additional loads produced by intermittent load modules 160-1 to 160-Y. The additional loads may draw additional power from the MMG power produced by engine 120, which affects the net power provided to MPR 130. For example, the development system may estimate the amount of power each parasitic load module 140-1 to 140-N may require based on particular design specifications. Based on the estimated power values, the MMG is determined (e.g., MMG=MMN+Pt). Accordingly, if the development system determines that one or more modules 140-1 to 140-N requires less power than received during operations, the gross power will be reduced, which, in turn, will reduce the net power actually delivered to MPR 130. Accordingly, the performance of system 100 may be degraded. Conversely, if the development system determines that one or more modules 140-1 to 140-N require more power than actually received during operations, the gross power may be increased, which, in turn, will increase the net power delivered to MPR 130. This may reduce the durability of system 100 and/or MPR 130, as well as result in component failures.

Accordingly, the MMG power determined by the development system does not consider the power required by the intermittent load modules 160-1 to 160-Y to avoid the risks associated with inaccurate determinations of load requirements exposed to engine 120. Because the intermittent load modules 160-1 to 160-N draw additional power from the gross power of engine 120, controller 110 may be configured with software that, when executed, determines a gross power based on not only parasitic load module 140-1 to 140-N, but also the intermittent load modules 160-1 to 160-Y included in system 100. Therefore, controller 110 may perform processes that dynamically determine new gross power limits, New MMG (NMMG), associated with engine 120 to ensure the net power provided to MPR 130 remains at constant level.

The dynamically determined NMMG power may be higher than the MMG previously determined by the development system because of the additional power drawn by the intermittent load modules 160-1 to 160-Y. For example, consider a tractor including an engine, a transmission receiving a maximum net power of 100 HP from the engine, a parasitic load module (e.g., cooling system) that receives 5 HP, and an intermittent load module (e.g., hydraulic-based system) that receives 10 HP of additional power from the engine. Based on the above exemplary power values, the gross power of the engine may be determined by the development system to be:

$$MMG=MMN+Pt$$

$$MMG=100\text{ HP}+5\text{ HP}=105\text{ HP}$$

During runtime operations of the tractor, however, the intermittent load module (e.g., hydraulic system) may be switched on, thus drawing 10 HP from the engine. Therefore, controller 110 may perform a dynamic gross power determination process that determines a net gross power (NMMG) reflected by the equation:

$$NMMG=MMN+Pt+It,$$

where It is the total power drawn by all intermittent load modules operating in the system, in this case the tractor. Therefore, because It=10 HP, and $$MMN=NMMG-Pt-It,$$

the actual net power delivered to the transmission may be:

$$MMN=105\text{ HP}-5\text{ HP}-10\text{ HP}=90\text{ HP},$$

which is 10 HP less that the transmission system can handle (e.g., 10 HP less than the maximum net power of 100 HP). Accordingly, controller 110 may be configured to increase the gross power provided by the engine to compensate for the low net power, thus, in the example above, producing a gross HP of 115 HP to allow the net power provided to the transmission to be $$MMN=115\text{ HP}-5\text{ HP}-10\text{ HP}=100\text{ HP}.$$

Additionally, the NMMG power dynamically determined by controller 110 may be lower than the MMG. For instance, consider the above exemplary tractor with a transmission net power limit of 100 HP, and an intermittent load module that draws 10 HP from the engine. However, in this example, consider that the development system determined that the parasitic load module is expected to draw 10 HP, while during actual operations of the tractor, the parasitic load module draws only 5 HP. Accordingly, the gross power determined by the development system and stored in the engine controller may be:

$$MMG=MMN+Pt(\text{developed})+It$$

$$MMG=100\text{ HP}+10\text{ HP}+10\text{ HP}=120\text{ HP}.$$

During operations, however, the actual net power delivered to the transmission is $$MMN=MMG-Pt(\text{actual})-It$$

$$MMN=120\text{ HP}-5\text{ HP}-10\text{ HP}=105\text{ HP},$$

which is 5 HP above the maximum net power that the transmission was determined to handle. Accordingly, controller 110 may be configured to dynamically reduce the NMMG power to 115 HP to decrease the net power provided to the transmission by 5 HP. Thus, $$NMMN=NMMG-Pt-It$$

$$NMMN=115\text{ HP}-5\text{ HP}-10\text{ HP}=100\text{ HP}.$$

Further, controller 110 may dynamically determine a NMMG power that is lower than the MMG based on an intermittent load module 160-1 to 160-Y being switched off during runtime operations. For example, consider the tractor with the transmission having a maximum net power capability of 100 HP, a parasitic load module that draws 5 HP and an intermittent load module that draws 10 HP from the engine. During operations, the gross power provided by the engine may be $$\text{Gross}=MMN+Pt+It$$

$$\text{Gross}=100\text{ HP}+5\text{ HP}+10\text{ HP}=115\text{ HP}.$$

When the intermittent load module switches "off", the net power applied to the transmission may be $$MMN=115\text{ HP}-5\text{ HP}=110\text{ HP},$$

which is 10 HP above what the transmission can handle. Accordingly, controller 110 may be configured to decrease the gross power NMMG by 10 HP to reduce the net power provided to the transmission to avoid excessive wear and/or failures. Therefore, after such an adjustment, the MMN may be $$MMN=NMMG-Pt$$

$$MMN=105\text{ HP}-5\text{ HP}=100\text{ HP}.$$

Figure 4:
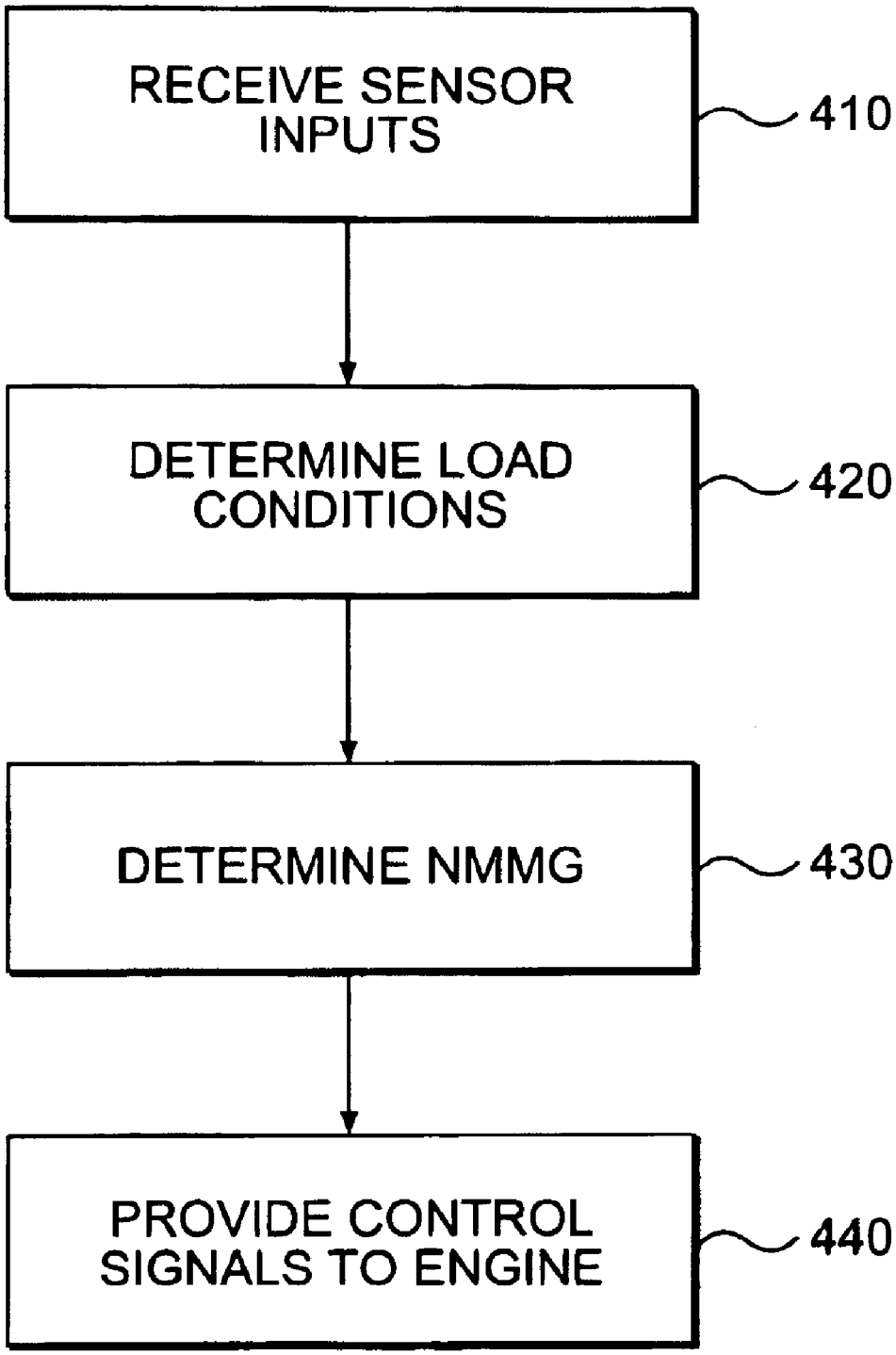
FIG. 4 illustrates a flowchart of an exemplary dynamic engine control process consistent with certain principles related to embodiments of the present invention.

To further describe the dynamic gross power determination embodiments of the present invention, FIG. 4 shows a flowchart of an exemplary dynamic engine control process that controller 110 may perform during runtime operations of system 100. As shown, during runtime operations of system 100, sensors 150-1 to 150-N and 170-1 to 170-Y may collect data associated with the operations of parasitic load modules 140-1 to 140-N and intermittent load modules 160-1 to 160-Y, respectively. The sensor data may be provided to controller 110 through, for example, interface 113 (Step 410). Controller 110 may be configured to retrieve the data from the sensors, or alternatively, the sensors may be configured to autonomously provide the collected data to controller 110. Further, sensors 155-1 to 155-X may provide data to controller 110 associated with various engine operating parameters during runtime operations. Additionally, sensors 155-1 to 155-X may provide data associated with the operations of MPR 130 based on the operations of flywheel 125, for example.

Once the sensor data is received, controller 110 may determine the load conditions placed on engine 120 (Step 420). In one embodiment of the invention, controller 110 may perform processes based on the software, hardware, firmware, etc. provided by the development system. The controller processes may utilize the data received form sensors 150-1 to 150-N and 170-1 to 170-Y to determine how much power from the parasitic and intermittent loads, if any, is received from engine 120 during runtime operations. Further, controller 110 may determine the net power provided to MPR 130 based on either sensor inputs or the gross power produced by engine 120 and the determined parasitic and intermittent loads. Based on the determined load conditions, controller 110 may dynamically determine a gross machine power level that engine should produce to maintain a constant net power to MPR 130 (Step 430). In one embodiment of the invention, controller 110 may execute software that ensures the net power delivered to MPR 130 is maintained at or near the maximum net power that MPR can handle, as previously determined by the development system. Controller 110 may also execute software that, in combination with a governor, for example, ensure that a predetermined power (e.g., MMN) to the MPR 130 is not exceeded.

Based on the determined gross machine power, parasitic and intermittent load power, and net power levels, controller 110 may provide control signals 115 to selected components within engine 120 that increase or decrease the gross power provided by engine 120 (Step 440). For example, control signals 115 may include signals that control fuel injection duration, timing, and/or pressure. Further, the control signals 115 provided by controller 110 may be configured to control other types of components known to those skilled in the art within engine 120 without departing from the scope of the present invention.

Figure 5:
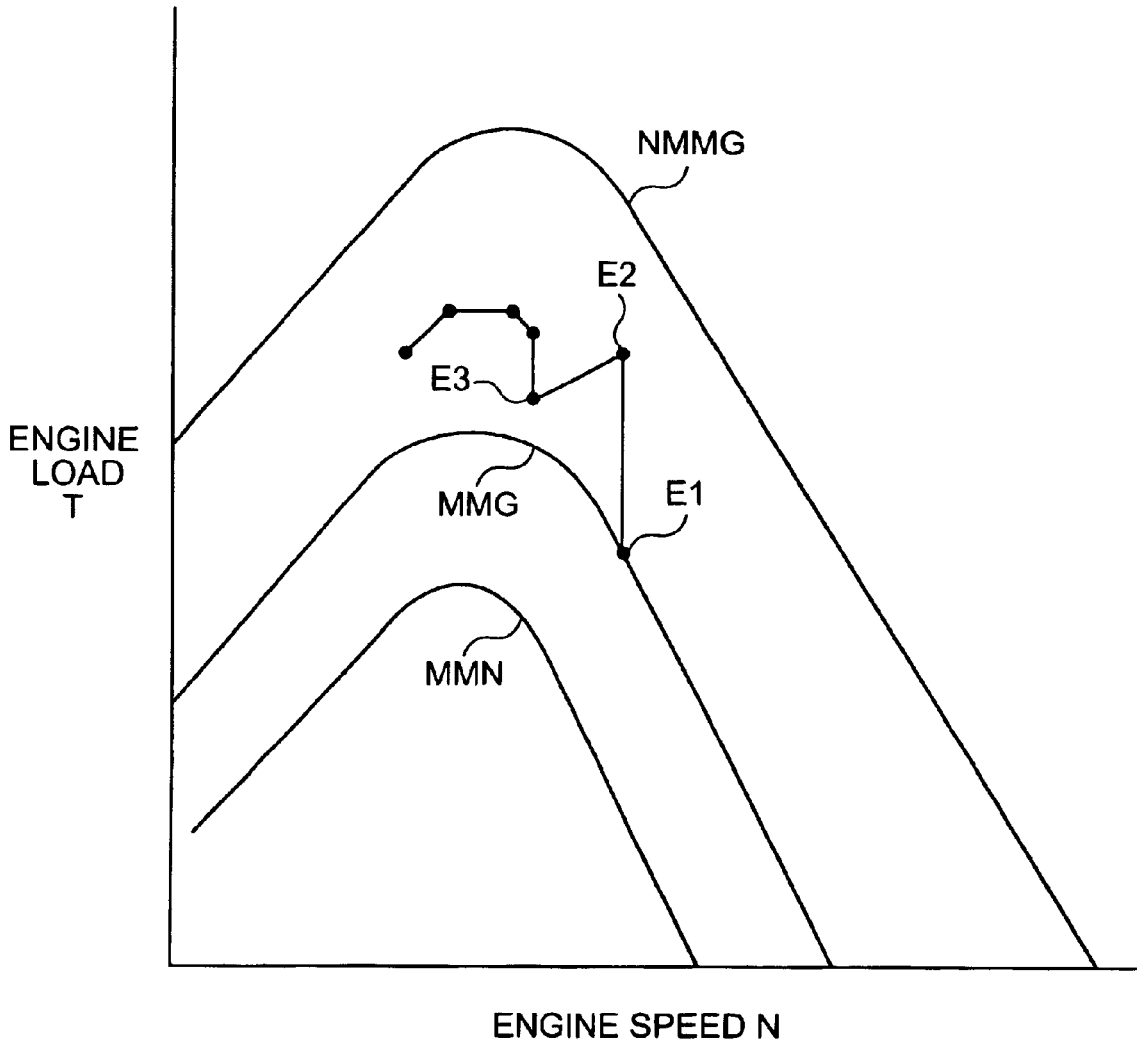
FIG. 5 illustrates an exemplary performance graph reflecting a dynamic engine control sequence consistent with certain principles related to embodiments of the present invention.

To further illustrate the dynamic gross power adjustment functions performed by controller 110 during runtime operations, FIG. 5 shows a diagram of a sequence of engine operations that controller 110 may control in relation to an exemplary performance graph according to one embodiment of the invention. As shown, the performance graph shows the MMN and MMG performance curves previously determined by the development system and stored as a performance map within memory 112. Additionally, the performance graph in FIG. 5 shows a NMMG power limit that is associated with the maximum power that engine 120 may provide when every parasitic load 140-1 to 140-N and intermittent load module 160-1 to 160-Y is operating while MPR 130 is drawing maximum net power, from flywheel 125 for example. Further, the MMG power limit in FIG. 5 reflects the gross power that engine 120 may provide when all parasitic load modules 140-1 to 140-N are operating, MPR is receiving full net power, and no intermittent load modules 160-1 to 160-Y are operating. Further, the MMN power level in FIG. 5 reflects the net power delivered to MPR 130 when power is not provided to any parasitic load module 140-1 to 140-N. As can be seen in the figure, controller 110 may perform processes that enable engine 120 to operate at performance levels above the MMG previously determined by the development system.

For instance, at event El, controller 110 may provide control signals 115 that direct engine 120 to provide a gross power level that supports the operations of the selected parasitic load modules 140-1 to 140-N that were used to determine MMG and the net power required by MPR 130. At event E2, an intermittent load module 160-1 to 160-Y may begin operations within system 100. For example, at event E2, system 100 may begin operating a hydraulic system that requires additional power from engine 120 above the predetermined MMG power. Accordingly, a sensor 170-1 170-Y associated with the hydraulic system may provide signals to controller 110 indicating that the hydraulic system is operating and the amount of power received from engine 120. Based on the received signals, controller 110 may determine a new gross power level that engine 120 should provide to ensure the net power provided to MPR 130 is maintained at a constant level (e.g., does not exceed or fall below the predetermined maximum net power limit). At event E3, the hydraulic system may be switched off and at the same time another intermittent load module may begin operations. Accordingly, controller 110 may dynamically provide control signals 115 that adjust the power provided by engine 120 based on events associated with updated parasitic and intermittent load conditions. Controller 110 may repeatedly perform the engine control process based on the changing load conditions to ensure that the engine 120 provides, for example, a constant net power to MPR 130.

INDUSTRIAL APPLICABILITY

Methods and systems consistent with certain features related to the present invention allow a controller to direct an engine operating in a host machine to provide a constant net power by dynamically adjusting the gross power produced by the engine based on varying parasitic and/or intermittent load conditions.

Figure 6:
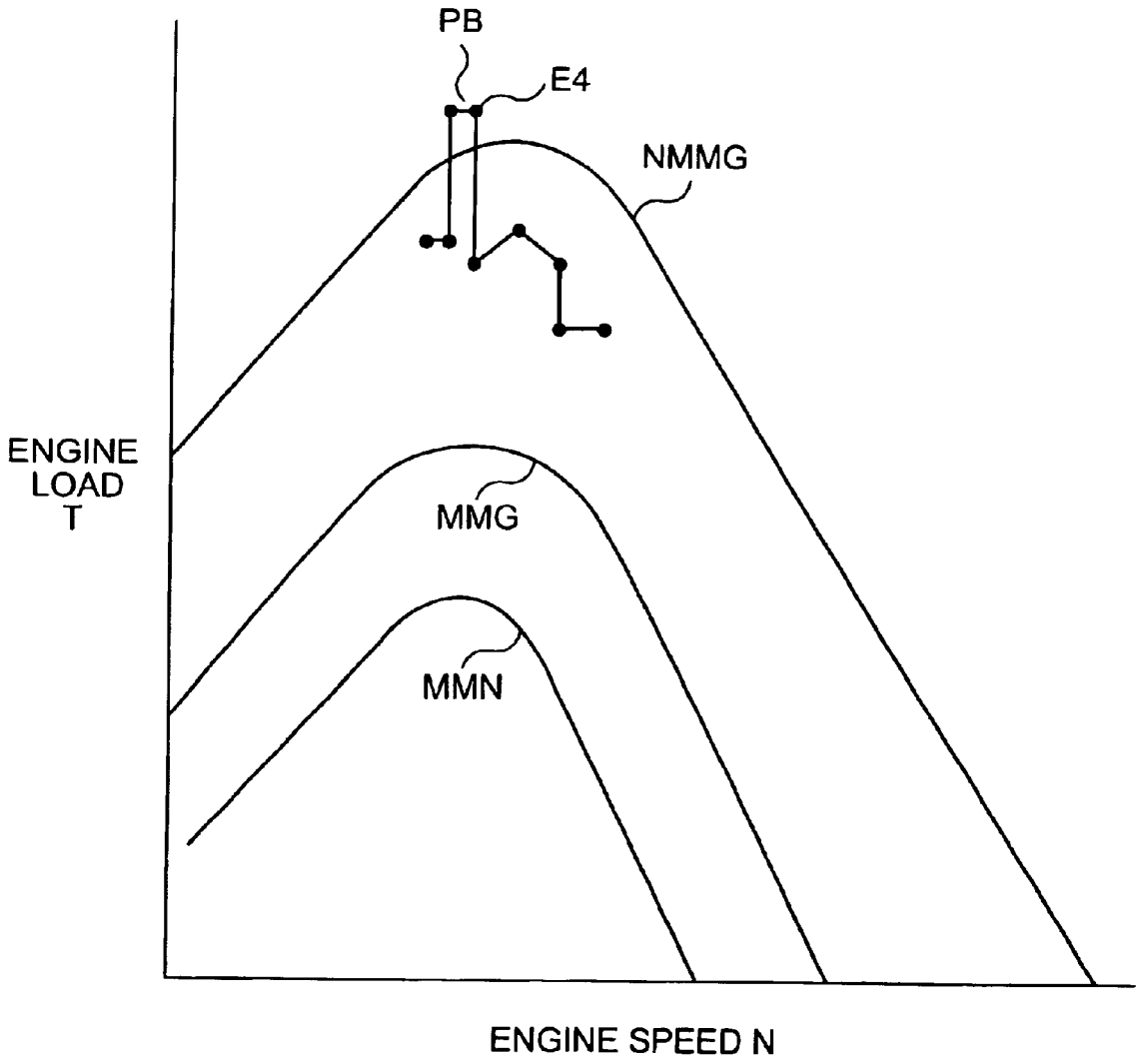
FIG. 6 illustrates an exemplary performance graph reflecting a power burst engine control sequence consistent with certain principles related to embodiments of the present invention.

In one embodiment of the present invention, based on selected load conditions associated with system 100, controller 110 may be configured to determine a "power burst" gross machine power level that may exceed the NMMG power level for a predetermined period of time. In this embodiment of the invention, controller 110 may receive data from sensors, such as 155-1 to 155-X, that indicate a condition that requires a net power applied to MPR 130 above a predetermined net power limit. For example, during runtime operations, a vehicle representing system 100 may approach a steep grade while hauling a large load of materials. Accordingly, controller 110 may receive signals from various sensors that indicate that the gross power provided by engine 120 may not be sufficient to handle the transient condition exposed to MPR 130, which may be a transmission system. For instance, the transmission system may shift to a lower gear to allow the vehicle to negotiate the steep grade without degrading system performance. Based on the received sensor signals, controller 110 may provide control signals 115 that allow engine 120 to temporarily provide a gross power level that exceeds the NMMG associated with system 100. The increase in gross power may allow the net power provided to MPR 130 to increase temporarily. For example, as shown in FIG. 6, event E4 may reflect a transient condition that requires a power burst from engine 120. Accordingly, controller 110 may provide control signals 115 that enable engine 120 to provide gross power that exceeds the NMMG power level for a predetermined amount of time, as indicated by PB in FIG. 6. The predetermined amount of time may be a value based on the level of the power burst and the power limits associated with MPR 130. The power burst information may be stored as power burst maps in memory 112 that are used by controller 110 to ensure that engine 120 does not sustain a power burst operation for a period of time that may result in damage to a parasitic or intermittent load module and/or MPR 130 or any of its components. Accordingly, for example, a drive train that is associated with a determined net power limit may temporarily receive power from flywheel 125 that exceeds the net power limit for a temporary amount of time to give system 100 additional power to handle certain transient conditions.

Further, the development system may determine the power burst maps based on various specifications associated with MPR 130. For example, information may be collected that reflects temporal based failure limits for MPR 130 based on engine speed and received net power. For example, a drive train with certain design specifications may have a MMN power limit of 100 HP at a given speed. This power level, however, may be exceeded for a certain amount of time, such as 5 seconds, without causing damage to the drive train. Accordingly, the development system may collect the power burst information for the type of MPR 130 that may be included in system 100 and store it in memory 112 for use by controller 110 during a power burst mode of operation.

In another embodiment of the invention, controller 110 may be configured to provide control signals 115 that reflect a percentage of the gross power that engine 120 should provide to maintain a constant net power to MPR 130 while providing power to parasitic and/or intermittent load modules. In this embodiment of the invention, the development system may determine a maximum gross power level associated with engine 120 based on every parasitic load and intermittent load module included in system 100, as well as the net power required by MPR 130. During runtime operations, controller 110 may execute software that dynamically determines a gross power level that engine 120 should provide to maintain the net power required by MPR 130 based on detected parasitic and intermittent loads received from sensors 150-1 to 150-N and 170-1 to 170-Y. In this embodiment, the gross power level determined by controller 110 may reflect a percentage of the maximum gross power level determined by the development system. For example, based on detected parasitic and/or intermittent load conditions, controller 110 may determine that 80% of the maximum gross power level is required to meet the demands of the parasitic and/or intermittent load modules and maintain a constant net power required by MPR 130.

Figure 7:
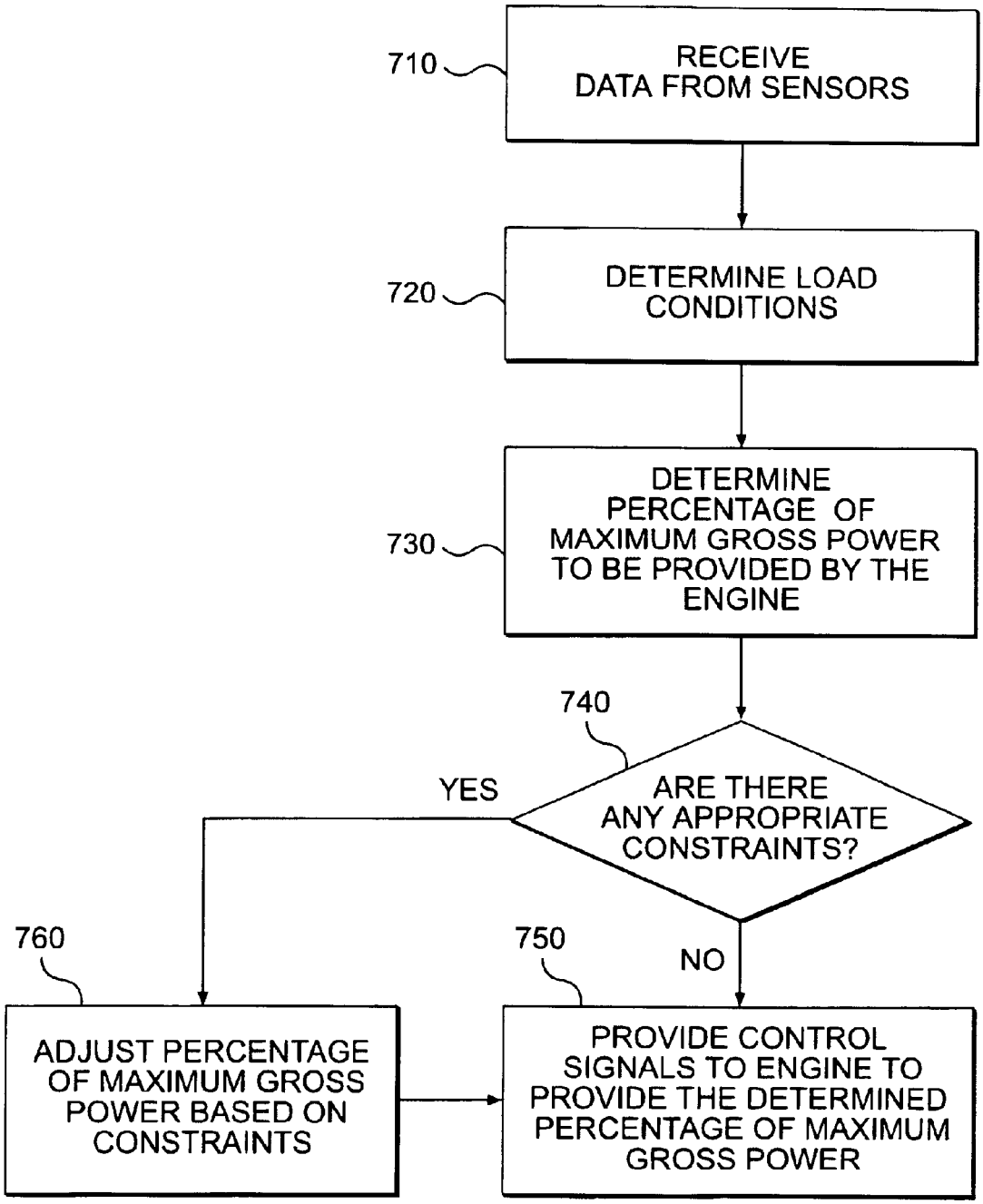
FIG. 7 illustrates a flowchart of an exemplary constraint based engine control process consistent with certain principles related to embodiments of the present invention.

In another embodiment of the invention, controller 110 may further include software that considers one or more constraints that are associated with various components operating within system 100 before providing signals 115 that represent a percentage of the maximum gross power level determined by the development system. For example, FIG. 7 shows a flowchart of a process that controller 110 may perform during runtime operations of system 100 according to one embodiment of the invention As shown, controller may receive data from sensors 150-1 to 150-N and 170-1 to 170-Y (Step 710). Based on the sensor inputs, controller 110 may determine the appropriate parasitic and/or intermittent load conditions placed on engine 120 (Step 720). Based on the determined load conditions, controller 110 may determine a percentage of the maximum gross power level that engine 120 should provide to meet the demands of the parasitic and/or intermittent loads and MPR 130 (Step 730). Prior to providing control signals 115 reflecting the determined percentage power level, however, controller may access data stored in memory 112 to determine whether there are any constraints associated with components of system 100 and the determined load conditions (Step 740). The constraints stored in memory 112 may be associated with various engine operating conditions that may affect the performance of system 100. For example, a constraint may be associated with a transient condition reflecting a change in terrain that system 100 is exposed to during operations (e.g., such as the type and/or grade of the terrain), a decrease or increase in the weight associated with material that system 100 is manipulating during operations, and a change in ambient conditions exposed to system 100, such as weather fluctuations (e.g., increase temperatures, precipitation, barometric pressure etc.). If there are no constraints associated with the detected load condition (Step 740; NO), controller 110 may produce control signals 115 that allow engine 120 to provide the percentage of maximum gross power determined in Step 730 (Step 750). On the other hand, if there is a constraint (Step 740; YES), controller 110 may adjust the determined percentage of the maximum gross power level to meet the determined constraints (Step 760). Once adjusted, controller 110 may then provide control signals 115 to engine 120 that reflect the adjusted percentage power level determined in Step 760 (Step 750).

For example, consider a tractor that is idling at a low engine speed. The operator of the tractor may, at some point, decide to perform a task quickly and subsequently engage the tractor's throttle to full power. Controller 110 may receive data from selected sensors within system 100 reflecting the increased throttle position and determine that a maximum amount of fuel should be applied to engine 120 to produce the requisite power based on the throttle position. However, engine 120 may not have enough air flow within its system to produce the power to perform the task desired by the operator. In such an example, the tractor may merely produce "black smoke" until the engine receives the appropriate amount of air/fuel mixture to produce the required power. In this embodiment of the invention, controller 110 may avoid a "black smoke" condition by accessing data in memory 112 that indicates a "black smoke" condition may occur based on the data received from the sensors within system 100. Accordingly, based on the detected constraint, controller 110 may reduce the percentage of the maximum gross power previously determined to meet the constraint, in this case to avoid a "black smoke" condition. For example, instead of controlling engine 120 to produce 80% of the maximum gross power, controller may determine that a constraint requires that only 70% of the maximum gross power be produced by engine 120 to avoid undesirable engine performance and then increase power to 80% as the appropriate air/fuel mix is delivered.

Further, the constraint features associated with this embodiment of the invention may be applied to other embodiments of the invention without departing from the scope of the invention. For example, the dynamic power control embodiments of the invention may determine whether any constraints apply to system 100 prior to providing control signals 115 to adjust the gross power delivered by engine 120. Also, the power burst embodiment of the invention may also allow controller 110 to determine whether any constraints apply prior to sending control signal 115 to engine 120. Based on the determination, the gross power provided by engine 120 may be adjusted via control signals 115.

In yet another embodiment of the invention, in addition to, or in place of, the dynamic gross power determination functions performed by controller 110, system 100 may be configured to determine a gross power level based on the performance curves determined for each parasitic load module 140-1 to 140-N included in system 100. In this embodiment, the development system may determine, for various operating conditions, e.g., engine speeds and/or loads, performance curves associated with each parasitic load module 140-1 to 140-N included within system 100. The development system may generate performance maps reflecting these performance curves and store them within memory 112 of controller 110. Therefore, during runtime operations of system 100, controller 110 may receive signals from sensors 150-1 to 150-N indicating which parasitic load modules are operating during the runtime operation and determine corresponding load conditions. Based on the determined load conditions, controller 110 may determine the gross power level that engine 120 should provide based on the performance curves reflected in the stored performance maps. For example, referring to FIG. 3, curves PC1 to PCN may reflect performance curves associated with various combinations of parasitic load modules operating during runtime operations of system 100. Based on detected parasitic load conditions, controller 110 may provide control signals 115 that allow engine 120 to operate at or near a respective performance curve. Accordingly, when a selected set of parasitic load modules 140-1 to 140-N are operating, controller 110 may access the performance maps to determine the appropriate performance curve for engine 120 should be operating and provide control signals to operate engine 120 accordingly. Further, controller 110 may perform interpolation functions to determine gross power levels that fall between performance curves PC1 to PCN.

In another embodiment of the invention, the performance maps stored in controller 100 may reflect performance curves associated with gross power levels based on the loads of the parasitic load modules 140-1 to 140-N and intermittent modules 160-1 to 160-Y included in system 100. In this embodiment, the development system may determine performance curves for various combinations of parasitic and/or intermittent loads exposed to system 100. Based on detected parasitic and intermittent load conditions during runtime operations, controller 110 may provide control signals 115 that allow engine 120 to produce a gross power level at or near a respective performance curve. Accordingly, when a selected set of parasitic and intermittent load modules are operating during runtime operations, controller 110 may access the performance maps to determine the appropriate performance curve that engine 120 should operate at or near and provide control signals 115 that allow engine 120 to produce a gross power level to meet the appropriate performance. Further, controller 110 may perform interpolation functions to determine gross power levels that fall between selected performance curves.

Additionally, controller 110 may be configured to perform both the performance curve process described immediately above and the previously described dynamic gross power adjustment processes during runtime operations. In this embodiment of the invention, controller 110 may perform an analysis process that compares the gross power level determined by the performance curves and the gross power levels determined using the dynamic power level functions associated with the process described in FIG. 4. Based on the comparison, controller 110 may determine whether either process is within an acceptable error threshold of the other. Based on this determination, controller 110 may select a gross power level that best represents the power that should be provided by engine 120. Further, controller 110 may use the comparison results of the analysis process to determine whether there is problem with the software executed by controller 110 to determine the various gross power levels. For example, in the event controller 110 determines that a gross power level determined using the performance curves stored in memory 112 is beyond a threshold value associated with a gross power level based on a dynamic gross power process, a signal may be generated that indicates to system 100, or an operator of system 100, that the software may need to be adjusted or tested.

In another embodiment of the invention, the dynamic gross power determination process performed by controller 110 may enable an engine manufacturer or developer to use the software executed in controller 110 to develop a single type of engine with predetermined performance iron characteristics to perform operations that conventional engine systems may perform using application specific software programmed within a controller. For example, an exemplary manufacturer may develop a plurality of 300 HP engines with controllers that include the same control software. Each 300 HP engine may be included in a host machine that requires different power specifications, without requiring the software within a corresponding controller to be adjusted. For instance, one 300 HP engine may be included in a machine that requires a gross power level of 200 HP, while another 300 HP engine may be included in a machine that requires 290 HP. In each of the above exemplary engines, a corresponding controller may include the same software that performs the dynamic gross power level determination process described above to ensure the gross power and net power delivered by the engine do not exceed specified limits. This may be an improvement over conventional engine development processes that require different software to be programmed into an engine controller based on the application of the engine and the host machine. That is, conventional development processes may provide engines with similar performance iron characteristics and different software based on the machine and desired application of the machine. This embodiment of the invention, on the other hand, allows engines with similar performance iron characteristics to be provided with the same software programmed within a corresponding controller. This may reduce costs associated with developing and/or manufacturing engines and their respective engine control systems.

In another embodiment of the present invention, the predetermined net power received by MPR 130 from engine 120 may be adjusted according to selected applications of system 100. Accordingly, the maximum net power associated with MPR 130 may be defined as a function of sensory and/or operator controlled inputs. Therefore, embodiments of the present invention enable MPR 130 to have operator and/or work-related application specific power limits. For example, a boom or stick of an excavator may be designed to handle various stress levels. Many factors may affect boom stress, such as the type of material excavated, speed of the boom, position of the boom, etc. Accordingly, when the excavator is manipulating loose material (e.g., sand), the material resistance is low and the net power provided by engine 120 may be increased without adversely affecting boom stress. When compact or dense material is manipulated by the excavator, net power provided by engine 120 may be reduced to limit boom stress. Accordingly, for example, sensors 155-1 to 155-X may be configured to provide sensor signals to controller 110 that reflect the stress levels associated with MPR 130 and the net power provided by engine 120 may be adjusted accordingly. Once the net power limit is re-defined, controller 110 may be configured to perform the engine control processes according to certain embodiments of the present invention.

The features, embodiments, and principles of the present invention may be implemented in various environments. Such environments and related applications may be specially constructed for performing the various processes and operations of the invention. The processes disclosed herein are not inherently related to any particular system, and may be implemented by a suitable combination of electrical-based components. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for controlling power provided by an engine operating with a machine, the method comprising:

determining a first power value reflecting a predetermined first power to be provided by the engine to a component;

determining, during machine operations, at least one of a parasitic power value reflecting power received by at least one parasitic load module from the engine and an intermittent power value reflecting power received by an intermittent load module from the engine;

determining, during machine operations, a second power value reflecting a second power provided by the engine based on the parasitic power value, the intermittent power value, and the first power value; and adjusting, during machine operations, the second power value based on changes in at least one of the parasitic power value and the intermittent power value such that the engine substantially provides the predetermined first power to the component, and adjusting the second power value such that the second power value fluctuates between a first maximum power that the engine may provide when the parasitic load module, the intermittent load module, and the machine component are receiving power from the engine and a second maximum power value that the engine may provide when the parasitic load module and the machine component are receiving power from the engine and the intermittent load module is not receiving power from the engine.

2. The method of claim 1, wherein the first predetermined power is a net power that the component receives from the engine.

3. The method of claim 1, wherein the second predetermined power is a gross power provided by the engine.

4. The method of claim 2, wherein the net power reflects a maximum net power that the machine component is designed to receive without experiencing substantial degradation of at least one of physical and functional attributes associated with the machine component.

5. The method of claim 1, wherein the dynamically adjusted second power is greater than a predetermined maximum power, the predetermined maximum power reflecting power to be provided by the engine when the intermittent load module is not receiving power from the engine while the parasitic load module and system component are receiving power from the engine.

6. The method of claim 5, wherein the predetermined maximum power further reflects gross power to be provided by the engine when a plurality of parasitic load modules and the machine component are receiving power from the engine.

7. The method of claim 3, wherein adjusting includes:

adjusting the gross power value based on an indication that the intermittent load module is not operating during the machine operations.

8. The method of claim 3, further including:

providing control signals to the engine that control one or more engine components that affect operations of the engine based on the adjusted gross power value.

9. The method of claim 2, wherein the predetermined net power value is determined prior to the operation of the machine.

10. The method of claim 1, wherein the parasitic power value reflects a total power provided by the engine to a plurality of parasitic load modules operating in the machine.

11. The method of claim 9, wherein the intermittent power value reflects a total power provided by the engine to a plurality of intermittent load modules operating in the machine.

12. The method of claim 1, wherein determining a first power value includes:

determining a maximum power value associated with the maximum power that the engine may provide based on power requirements associated with one or more parasitic load modules, one or more intermittent load modules, and the net power, wherein the adjusted second power value reflects a percentage of the maximum power value.

13. The method of claim 1, wherein adjusting further includes:

determining whether a constraint applies to the machine operations; and readjusting the adjusted second power value based on a determination whether a constraint applies to the machine operations.

14. A method for controlling power provided by an engine included in a machine, comprising:

determining a net power value reflecting a predetermined net power to be provided by the engine to a machine component included in the machine;

determining a maximum amount of gross power that the engine is to provide when one or more parasitic load modules, the machine component, and one or more intermittent load modules are receiving power from the engine during machine operations;

controlling a current gross power provided by the engine during machine operations based on determined power values associated with at least one of the one or more parasitic and the intermittent load modules such that the machine component consistently receives the predetermined net power and the current gross power does not exceed the maximum amount of gross power;

determining a transient condition during machine operations that indicates extra power is required by the machine component; and adjusting, based on the determined transient condition, the current gross power provided by the engine such that the current gross power exceeds the maximum amount of gross power for a predetermined amount of time.

15. The method of claim 14, wherein the maximum amount of gross power is greater than a second maximum amount of gross power that the engine is to provide during machine operations when the one or more parasitic load modules and the machine component are operating and the one or more intermittent load modules are not operating.

16. The method of claim 14, wherein the determined amount of time is based on previously collected information associated with physical and functional operating limits of the machine component.

17. The method of claim 14, wherein adjusting the current gross power provided by the engine increases the net power provided to the machine component for the determined amount of time.

18. The method of claim 17, wherein the increased net power exceeds the predetermined net power for the determined amount of time.

19. The method of claim 17, wherein the external factor is associated with at least one of a change in terrain that the machine is exposed to during machine operations, an increase in a weight associated with material the machine is manipulating during machine operations, and a change in ambient weather conditions that affect the performance of one or more components of the engine.

20. A method of providing engines that allow for dynamically adjustable gross power, comprising:

developing a plurality of engines each with similar design characteristics including a designed gross power that the respective engine is designed to provide;

providing, for each engine, software in a controller that is configured to dynamically adjust the designed gross power provided by the engine based on data reflecting an amount of power provided by the engine to at least one of one or more parasitic load modules and one or more intermittent load modules, such that the engine provides a constant net power to an output component of the engine;

providing a first engine of the plurality of engines in a first machine that requires a first net power from the output component of the first engine;

providing a second engine of the plurality of engines in a second machine that requires a second net power from the output component of the second engine, wherein the second net power is different from the first net power;

operating the first engine in the first machine such that the controller associated with the first engine controls the first engine to constantly provide the first net power at the output component of the first engine regardless of power received by at least one of a one or more parasitic load modules and one or more intermittent load modules operating in the first machine; and operating the second engine in the second machine such that the controller associated with the second engine controls the second engine to constantly provide the second net power at the output component of the second engine regardless of power received by at least one of a one or more parasitic load modules and one or more intermittent load modules operating in the second machine.

21. A system comprising:

an engine configured to provide a net power to an output component of the engine;

at least one of one or more parasitic load modules that each are configured to receive parasitic power from the engine, and one or more intermittent load modules that each are configured to receive intermittent power from the engine;

a receiving component for receiving the net power from the output component; and a controller configured to:

determine, during engine operations, a gross power provided by the engine based on the parasitic power received by the net power and at least one of the one or more parasitic load modules and the intermittent power received by the one or more intermittent load modules, and adjust, during engine operations, the gross power based on changes in at least one of the parasitic power value and the intermittent power value such that the engine provides a constant net power to the output component, wherein the controller adjusts the gross power such that the gross power fluctuates between a first maximum gross power that the engine may provide when the one or more parasitic load modules, the one or more intermittent load modules, and the system component are receiving power from the engine and a second maximum gross power that the engine may provide when the one or more parasitic load modules and the system component are receiving power and the one or more intermittent load modules are not receiving power from the engine.

22. The system of claim 21, wherein the adjusted gross power is greater than a predetermined maximum gross power reflecting power to be provided by the engine when the one or more intermittent load modules are not receiving power from the engine while the one or more parasitic load modules and system component are receiving power from the engine.

* * * * *